United States Patent [19]

Denham et al.

[11] Patent Number: 4,765,175

[45] Date of Patent: Aug. 23, 1988

[54] APPARATUS FOR INSTALLING FASTENERS

[75] Inventors: Keith Denham, Welwyn Garden City; Glenn Stride, Hitchin; Jonathan L. Brewer, Dunstable, all of England

[73] Assignee: Avdel Limited, Hertfordshire, England

[21] Appl. No.: 907,099

[22] Filed: Sep. 15, 1986

[30] Foreign Application Priority Data

Sep. 19, 1985 [GB] United Kingdom ..... 8523159

[51] Int. Cl.[4] ..... B21D 31/00

[52] U.S. Cl. ..... 72/391; 227/112; 29/243.53

[58] Field of Search ..... 227/53, 55, 119, 52, 227/139, 107, 149, 112; 72/391, 453.17; 29/243.53

[56] References Cited

U.S. PATENT DOCUMENTS

| | | | |
|---|---|---|---|
| 3,367,166 | 2/1968 | Newton et al. | 72/453.17 |
| 3,580,457 | 5/1971 | Henshaw | 227/116 |
| 3,695,086 | 10/1972 | Savage | 72/391 |
| 4,368,838 | 1/1983 | Sheffield et al. | 227/55 |
| 4,628,722 | 12/1986 | Mauer et al. | 72/453.17 |
| 4,643,344 | 2/1987 | Kaita et al. | 227/112 |

FOREIGN PATENT DOCUMENTS 2118086 10/1983 United Kingdom .

*Primary Examiner*—Frank T. Yost
*Assistant Examiner*—James L. Wolfe
*Attorney, Agent, or Firm*—Oblon, Fisher, Spivak, McClelland & Maier

[57] ABSTRACT

Apparatus for automatically installing blind rivets includes structure for automatically feeding new rivets one at a time to the front of the rivet installation head. Each rivet is supported in the appropriate position by a pair of support fingers (36,36) whilst the installation head (19) advances towards the rivet. The rivet feeding structure is provided with rivet guiding fingers (51,51) which guide the rivet stem (41) into the approaching anvil aperture (48) in the installation head. As the installation head continues to advance, it pushes out of the way first the guiding fingers (51,51) and then the support fingers (36,36) so that the rivet can reach the workpiece and be installed in it.

10 Claims, 7 Drawing Sheets

APPARATUS FOR INSTALLING FASTENERS

The invention relates to apparatus for installing fasteners, and more particularly to such apparatus which includes a fastener installation head including an aperture into which one part of the fastener is inserted so that the fastener can be acted upon by the installation head when another part of the fastener is inserted in a workpiece, thereby to instal the fastener in the workpiece, and also includes fastener feeding means for feeding new fasteners successively to the installation head.

Such apparatus is used for installing, for example, blind rivets of the type comprising a stem which is inserted in the aperture in the installation head, and a shell which is inserted in a workpiece. The installation head pulls the stem with respect to the shell to expand the shell, and thereby instal the rivet in the workpiece.

Such installation apparatus has commonly had new fasteners fed to it one at a time by hand, which slows down the rate of use of the tool. Various proposals have been made for feeding new fasteners successively automatically. In one type of apparatus, fasteners are fed from within the tool to the back of the aperture (i.e. the side thereof which, in use, is remote from the workpiece). In another type of apparatus, fasteners are fed to the front of the aperture (i.e. the side thereof which, in use, is nearer the workpiece). The present invention is concerned with the second type of apparatus.

In order for the apparatus to work effectively, the aperture must be a fairly close fit around the part of the fastener which is inserted into it. This causes problems, and the present invention is directed towards overcoming those problems.

The present invention provides apparatus for installing fasteners, which apparatus includes:

a fastener installation head including an aperture into which one part of the fastener is inserted so that the fastener can be acted on by the installation head when another part of the fastener is inserted in a workpiece, thereby to instal the fastener in the workpiece;

and fastener feeding means for feeding new fasteners successively to the front of the aperture of the installation head;

which fastener feeding means comprises:

fastener supporting means which can take up an operative position for supporting a new fastener to be inserted into the aperture of the installation head, the fastener supporting means and the fastener installation head being movable relative to each other so that the aforesaid one part of the fastener approaches the aperture to enter therein, and fastener guiding means which can take up an operative position for guiding the said one part of an approaching fastener into the aperture, each of the fastener supporting means and fastener guiding means being movable to a retracted position in which it allows the aforesaid second part of the fastener access to a workpiece in which it is to be installed whilst the first part of the fastener is still inserted into the aperture in the fastener installation head to be acted on thereby.

Further features of the invention are defined in the appended claims.

A specific embodiment of the invention will now be described by way of example and with reference to the accompanying drawings, in which: FIG. 1 is a schematic diagram illustrating a blind rivet installation system, including installation apparatus according to the present invention together with associated control equipment;

FIGS. 2A, 2B and 2C are respectively a side elevation, plan view and end elevation showing the rivet transfer and supporting means at, the start of its transverse movement;

FIGS. 3A, 3B and 3C similarly show the rivet transfer means at the end of its movement;

In various Figures, various parts are shown broken away, or in phantom, for clearer illustration.

Figure 1:
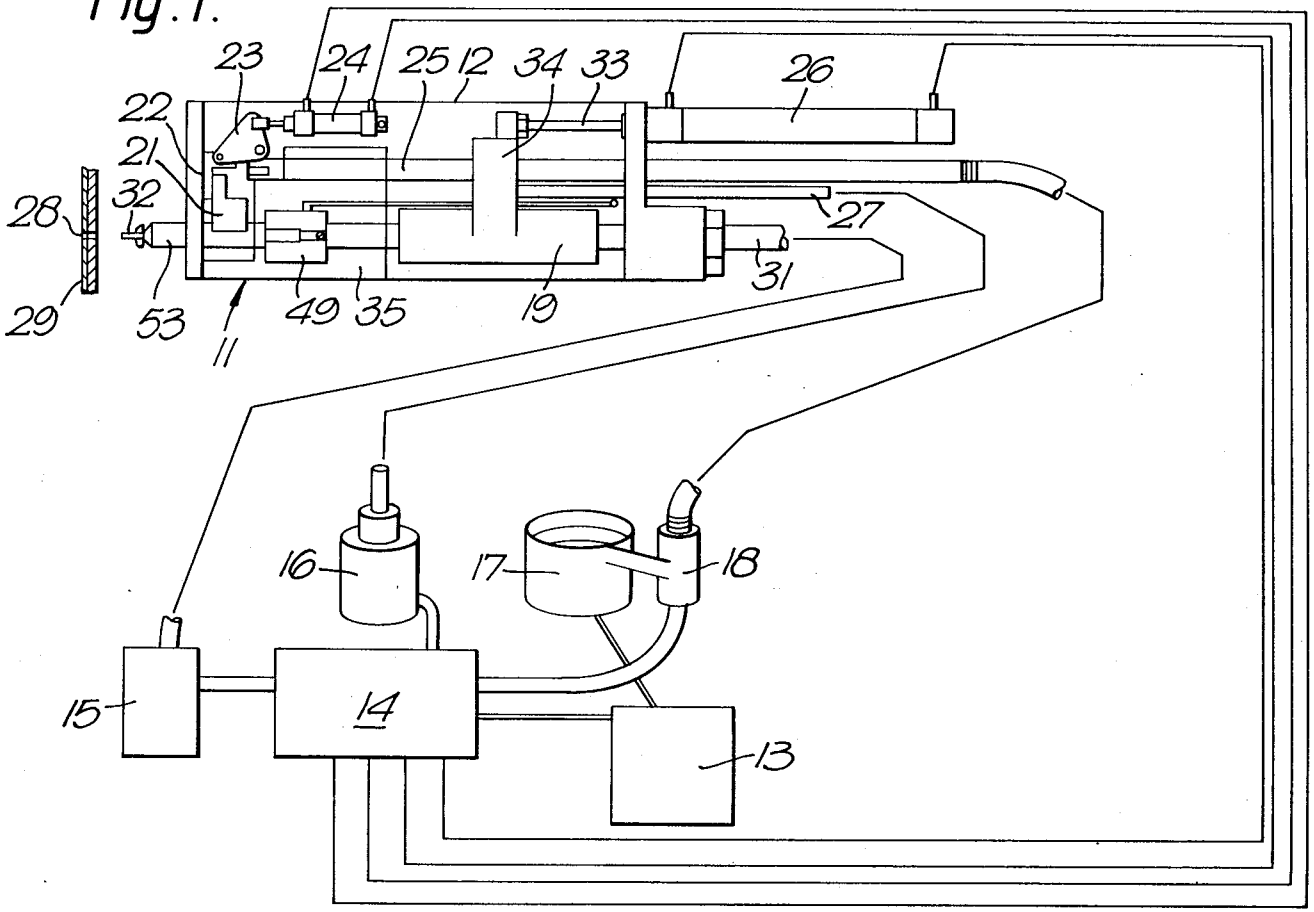

Referring first to FIG. 1, the system for automatically and repetitively installing blind rivets comprises the installation apparatus 11 which is built within a rigid frame 12. The system is powered and operated by pneumatic and pneumatic/hydraulic means. To this end it comprises a pneumatic pressure source 13, pneumatic sequence controller 14, vacuum generator and rivet pintail collector 15, pneumatic/hydraulic intensifier 16 to power the hydraulically operated rivet installation head, rivet bowl feeder 17 and single rivet feeder 18. The units 15, 16 and 18 are connected to and controlled by the sequence controller 14 so as to feed new rivets one at a time to the installation apparatus 11 and to control its operation in the way which will be described later.

The installation apparatus 11 includes a reciprocable rivet installation head 19. New rivets are fed in front of it, one at a time, when it is in its rearward position, by means of rivet feeding means comprising rivet supporting means 21 which is movable transversely on a slide 22 actuated through bell-crank 23 by a double-acting pneumatic actuator 24, controlled by the sequencer 14. New rivets from the single feeder 18 are blown one at a time into a feed tube 25, from the front end of which the rivet supporting means 21 transfers one rivet at a time to a pick-up position in front of the installation head 19. The installation head 19 is reciprocated axially by a double-acting pneumatic actuator 26, controlled by sequencer 14. The head includes within it a hydraulic actuator, fed by hydraulic pipe 27 from the intensifier 16 which is controlled by the sequencer 14. After each rivet 32 has been installed in a hole such as 28 in a workpiece 29, the part of the stem (known as the pintail) which has been gripped and pulled by the head 19 is broken off and released by the head, from where it travels rearwardly down a pintail extractor pipe 31, to the pintail collector 15, into which it is sucked by the vacuum source.

Systems generally similar to that as described up to this point are known in the art of fastener installation. The use of a pneumatic sequencer such as 14 for automatically controlling the various elements of the system is well understood and will not be described further. In the following description it will be assumed that the operation of various elements of the system, and the various elements of the installation apparatus 11 in particular, are operated at the appropriate times by the sequencer 14.

As shown in FIG. 1, the head-reciprocation actuator 26 is mounted outside the rear end of the frame 12 and is connected to reciprocate the installation head via a rod 33 which is secured to a lateral extension 34 of the body of the head.

Figure 2A:
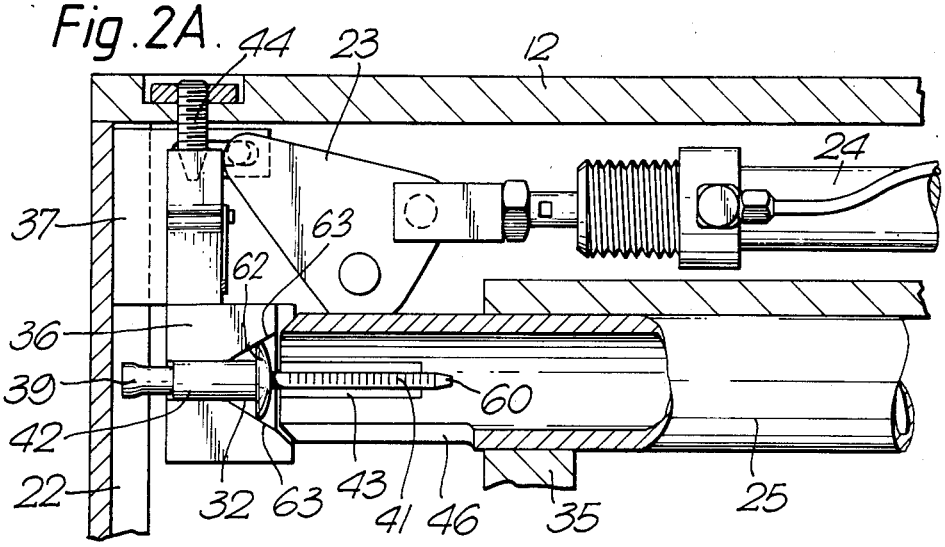
Figure 2B:
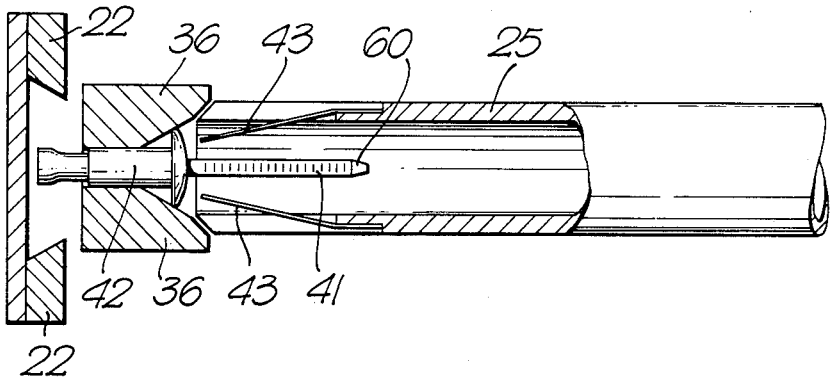
Figure 2C:
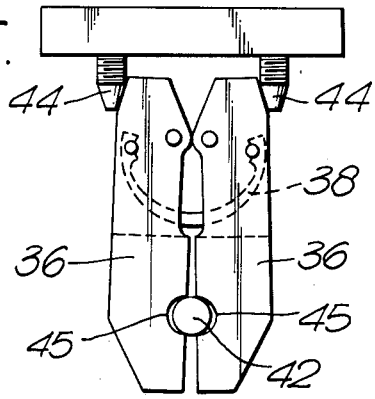

Referring now to FIGS. 2 onwards, the frame 12 includes a block 35 which has various bores through it to locate the main components of the apparatus.

Figure 6:
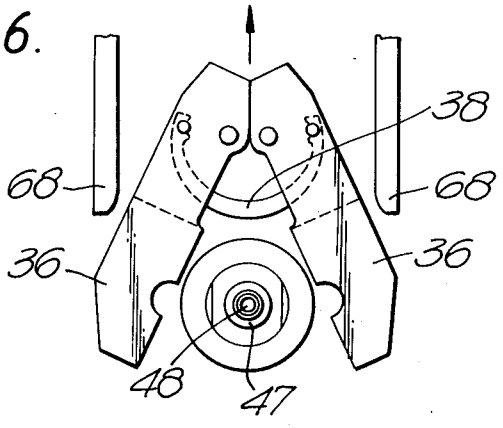
FIG. 6 is an end elevation of the guiding means showing it at a still later stage in its operation.
Figure 7:
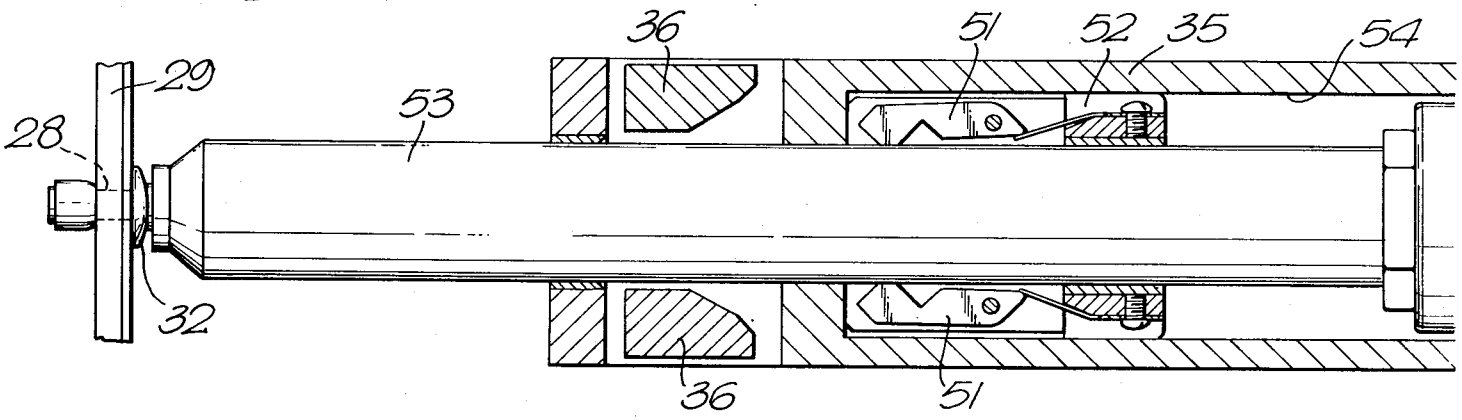
FIG. 7 is a plan view showing the installation head and guide means when the former is at the stage of installing a rivet.

FIG. 2 shows the rivet support means, which also acts as the transfer means. It comprises a pair of rivet support members in the form of a pair of support fingers 36 each of which is pivoted to a base 37 which slides on the transverse slide 22. The fingers are provided with a circlip-type spring 38 which has an over-centre action to urge the fingers towards each other into their support position (FIG. 3) or away from each other to their retracted position (FIGS. 6 and 7).

The rivets used in this example apparatus are of the well-known type comprising a stem having a head 39 and a pintail 41, together with an expansible shell 42. Rivets are blown one at a time along the feed tube 25 in a shell-first orientation and arrive at the support fingers 36 opposite the end of the tube. Two leaf springs 43 at the end of the tube prevent the return of a rivet back up the tube.

The support fingers 36 when at this end of their transverse travel along the slide 22 are held slightly open by engagement of their rear ends with two pegs 44, so that the rivet shell 42 can enter between the semi-circular bites 45 of the fingers. The momentum of the moving rivet carries it forwards until its radially projecting preformed shell head 62 abuts the recessed part-conical faces 63 of the support fingers. When the ram 24 is actuated, the crank 23 moves the base 37 and fingers 36,36 away from the pegs 44,44 so that the fingers 36 close on the rivet shell 42 and grip it sufficiently tightly to support it, as in FIG. 3.

The rivet pintail passes through a slot 46 in the end of the feed tube 25, and the rivet support means continues to move along the slide 22. The rivet pintail 41 passes through a slot 40 in the block 35. The support means stops at the other end of the slide in which position it presents the rivet in the pick-up position, as shown in FIG. 3.

Figure 8:
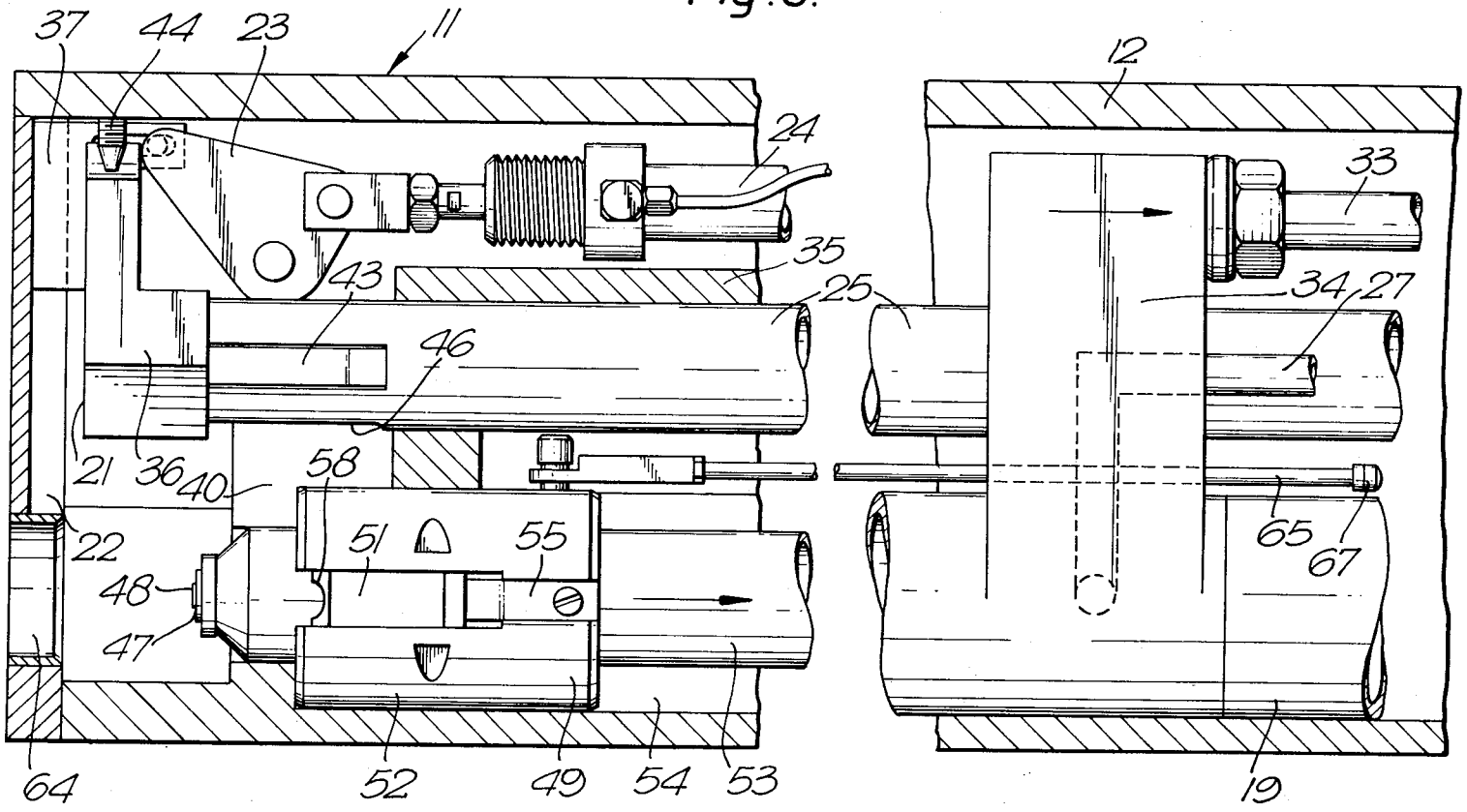
FIGS. 8 and 9 are side elevations showing the apparatus at still later stages in its operation.

The rivet installation head is in essence conventional in construction and operation, except that its body has the extension 34 to which is connected the rod 33 from actuator 26, which causes it to reciprocate in a bore in the frame block 35. The hydraulic pressure feed line 27 also enters the head through the extension 34, as illustrated in FIG. 8. The head is provided with the usual nose tip anvil 47 having a central aperture 48 which is a fairly close fit around the rivet pintail 41 which is inserted into it. The head contains, internally, conventional pintail gripping and pulling jaws, which grip and pull the pintail to instal the rivet upon the application of hydraulic pressure to the head, under the control of sequencer 14.

Figure 3A:
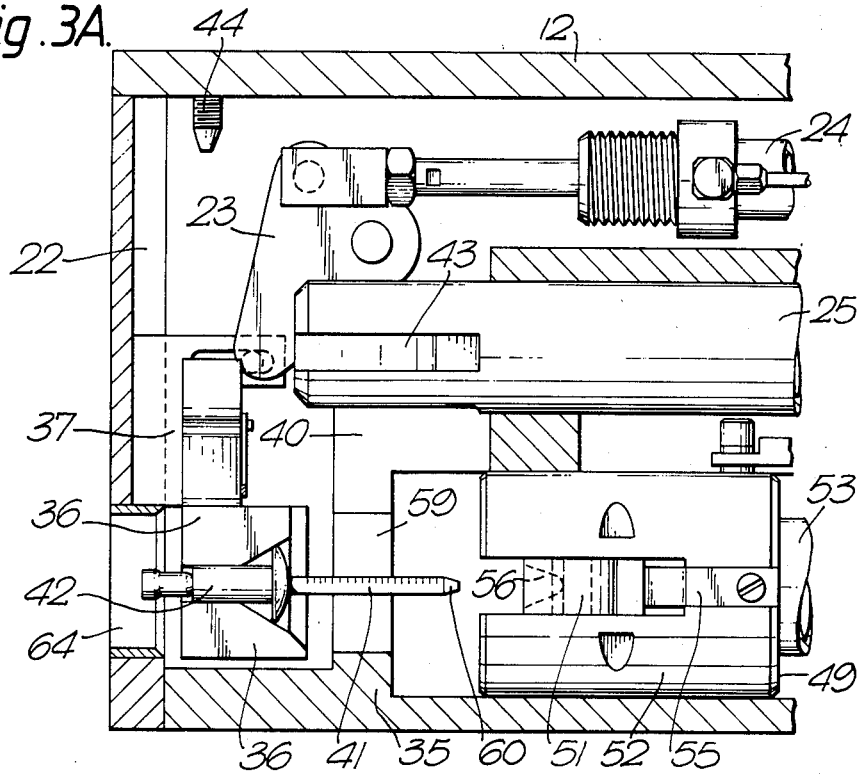
Figure 3B:
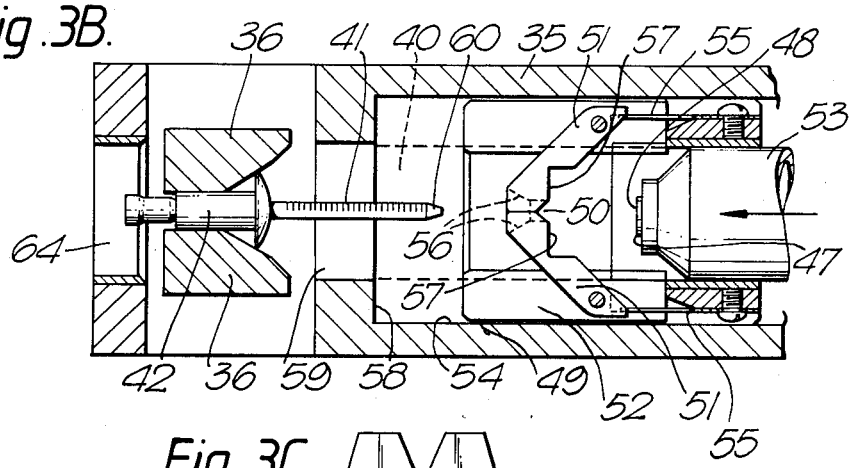
Figure 3C:
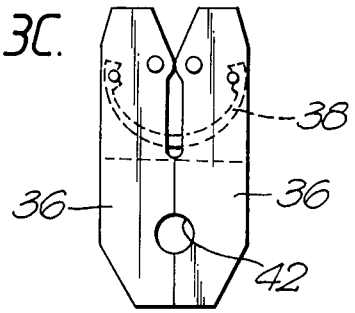

The head 19 is in its rearward position, when the rivet support means approaches and reaches the position in front of the head, supporting the rivet in the pick-up position as shown in FIG. 3. The pintail 41 of the rivet is opposite the anvil aperture 48, so that as the head advances towards the rivet, the end of the pintail enters into the aperture 48. However, since the fingers 36 grip and support the rivet by its shell 42, which is at the end remote from the end 60 of the pintail 41 which will enter the head aperture 48, it is possible that under certain conditions the rivet may not have adequate axial alignment with the approaching head aperture 48, and would not enter it. This would cause a machine malfunction of a more or less serious kind.

In order to ensure that the pintail is aligned with approaching head aperture 48, the apparatus of this example is provided with fastener guiding means, indicated generally by reference numeral 49. In this example, the fastener guiding means comprises a pair of guiding members in the form of guiding fingers 51,51. These are carried within a collar 52 which surrounds the front part or barrel 53 of the installation head 19 and can slide along it and also slide within the bore 54 in the frame block 35. The guiding fingers are urged towards each other into their operative position (FIG. 3) by two leaf springs 55,55 carried on the collar 52. The end of each guiding finger is provided on its front side with a part-conical recess 56 and on its rear side with a part circular recess 57. When the guiding fingers are closed together in their operative position, the two part-conical recesses 56 co-operate to form a conical guiding face for the end of the pintail. The rear end of this conical face provides a circular aperture 50, which is of the same diameter as the anvil aperture 48 and accurately aligned with it. The two part-circular recesses 57 together receive the front end of the head nose tip.

In FIG. 3, the installation head 19 is shown retracted with its front end anvil 47 spaced away from the rear side of the guiding fingers 51. This makes clearer the illustration, and this spacing can be provided, but it is not necessary, and the installation head 19 need be retracted only sufficiently far that the guiding fingers close together in front of it.

Figure 4:
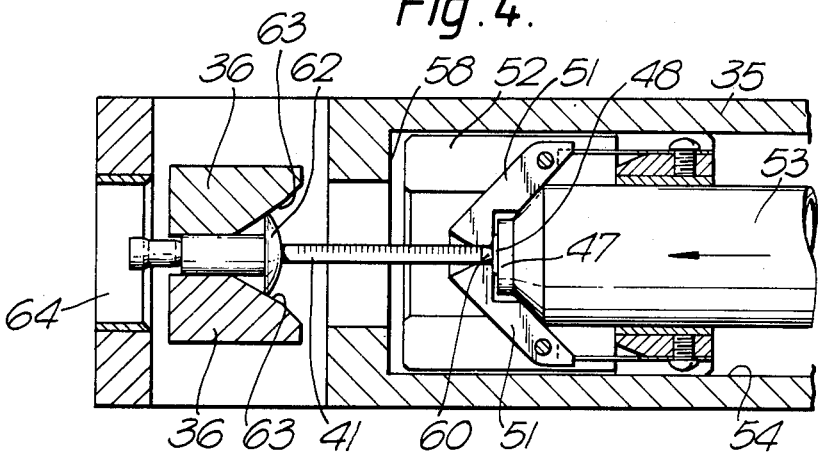
FIGS. 4 and 5 are plan views of the rivet guiding means and the front of the installation head at successive stages in their operation.

Whether or not this spacing is provided, the installation head 19 is now advanced by the ram 26 under control of the sequencer 14. Either the nosetip is already in contact with the recesses 57 in the back of the fingers 51, or it soon comes in to contact with them. The springs 55 are sufficiently strong that they keep the fingers 51 closed together, in their operative position, and the advancing installation head pushes the guiding collar 52 forwards in front of it. The conical guiding face comprising the two faces 56 on the front of the guiding fingers reach the tailmost end 60 of the rivet pintail (which is slightly bevelled to aid its entry), and guide the end of the pintail to enter, the guiding aperture 50, so that it is then accurately aligned with the aperture 48 in the adjacent anvil 47. This position is shown in FIG. 4.

Figure 5:
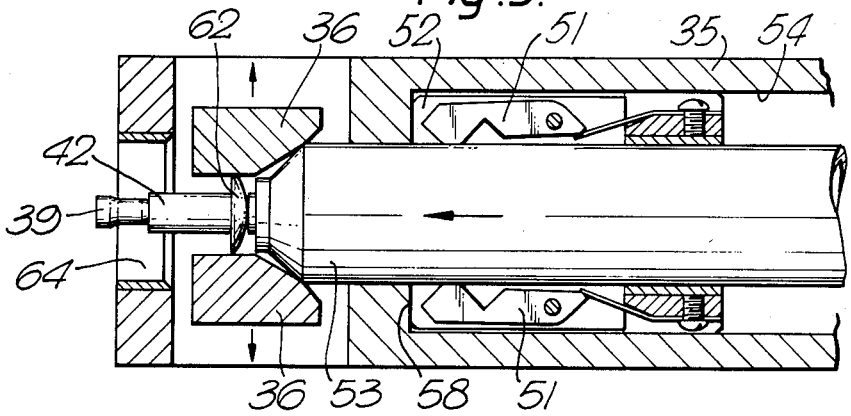
Figure 10:
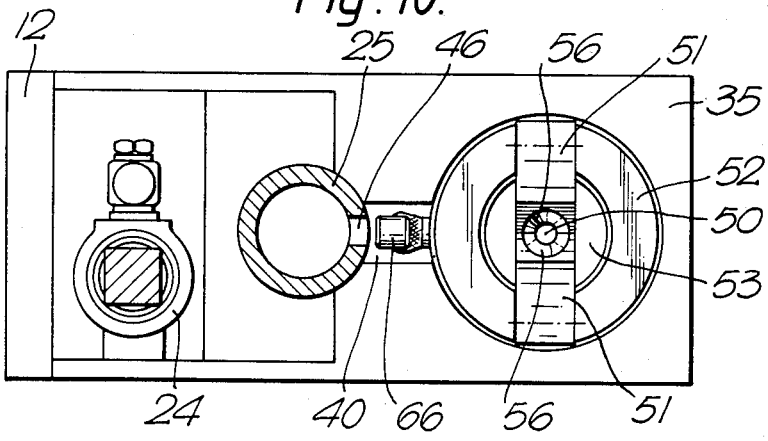
FIG. 10 is a cross-section on the line X—X of FIG. 9.

In order that the guiding fingers 51 can perform their guiding function they have to be positioned in front of the anvil 47, i.e. in their operative position. However, before the rivet pintail 41 can be fully inserted into the anvil aperture 48, it is necessary for the guiding fingers to be moved out of the way. This is achieved by providing for the front end of the installation head 19 to push them out of the way. The collar 52 continues to move forwards under the pushing of the installation head behind it, until it reaches a stop provided by the end face 58 of the bore 54. When this happens, the collar 52 cannot move any further forwards, and the forwards force on the installation head 19 provided by the ram 26 overcomes the urging of the leaf springs 55. The front end of the installation head pushes the guiding fingers apart, into their retracted positions, so that it can pass forwards between them, as illustrated in FIG. 5. The front end of the installation head barrel 53 passes forwards through an aperture 59 at the front end of the bore 54.

The rivet has continued to be supported and held by the support fingers 36, which are urged together by the spring 38. As the installation head continues to advance, the support fingers continue to hold the rivet in the pick-up position (FIG. 4), so that the pin-tail 41 progressively enters the anvil aperture 48. When the anvil 47 meets the nearer end face 61 of the nearer end end of the rivet shell 42, it picks up the rivet. The forwards urging force of the installation head pushes the rivet shell preformed head 62 against the adjacent faces 63 of the support fingers. These faces are also part-conical, so that as the installation head pushes the rivet forwards, the rivet shell head starts to force the fingers apart by a wedging action. The rivet starts to pass forwardly through the fingers, and very soon the front end of the installation head barrel 53, which is suitably tapered, contracts the part-conical faces 63 on the support fingers 36 and continues to force them apart against the urging of their spring 38. This is the stage illustrated in FIG. 5. It will be seen that the stem head 39 is just protruding from the aperture 64 in the end wall of the frame 12 through which the installation head barrel 53 will later project to gain access to the workpiece.

Whereas the guiding fingers 51 are fairly lightly sprung together so that they meet each other, the supporting fingers 36 have to grip the rivet quite firmly to keep it in the pick-up position. Consequently the spring 38 urges the free ends of the support fingers 36 together with a substantial force, which would cause damage to both the fingers and the outside of the installation head barrel 53 if the fingers remained pressed against the latter as it moved forwards between them. To avoid this it is arranged that, before the fingers reach the maximum extent apart to which they are forced by the barrel 53 entering between them, the over-centre position of spring 38 is reached and the spring automatically urges the support fingers fully apart, removing them from further contact with the barrel 53, as illustrated in FIG. 6.

The installation head continues to advance so that its front end emerges from the aperture 64 in the frame end wall, carrying rivet 32 in front of it, retained in the aperture 48 by the gripping and pulling jaws inside the installation head, as is conventional. The installation head comes to rest at the forward end of its travel, and the aperture 28 of a workpiece 29 (e.g. two sheets to be riveted together) is placed over the rivet shell by an operator, or suitable robot mechanism (alternatively the workpiece could be held in the correct place so that the rivet shell enters the aperture 28 at the end of the installation head travel).

The installation head is now actuated in the usual way, by the application of hydraulic pressure as previously described. The gripping and pulling jaws within the head pull on the pintail of the rivet, expanding the shell within and behind the workpiece aperture, to instal the rivet in the workpiece. The pintail breaks off and is sucked away through the pintail extractor pipe 31.

Meanwhile the actuator 24 has been operated in the reverse direction, to move the open support fingers 36 transversely back towards the rivet feed tube 25. In order to close the fingers it is arranged that their outside faces strike a pair of fixed lugs 68 (FIG. 6) carried on the frame 11 which close the fingers together sufficiently far that the spring 38 goes over-centre again and urges the fingers closed. They are then opposite the end of the rivet feed tube 25, held slightly open by pegs 44, ready to receive another new rivet blown down the tube (FIGS. 8 and 9).

The actuator 26 has also been operated in the reverse direction, to pull the installation head back so that the next rivet can be fed in front of it. The guiding collar 52 must also be moved back for the same purpose, but since the collar has not moved forwards beyond the stop face 58, it does not have to be retracted so far. Both these different amounts of reverse movement are achieved together by providing lost motion between the installation head 19 and the collar 52. A rod 65, which passes through a bore in the extension 34, has its front end secured to the collar 52, by connector 66. The rear end of the rod projects behind the extension 34 and ends in an oversize stop 67 which will not enter the bore in the extension 34. When the installation head starts to move backwards, the guiding collar 52 remains at the front end of the bore 54 until the rear face of the extension 34 meets and picks up the end stop 67 of the rod 65. The relative dimensions of the parts concerned are arranged such that the installation head retracts sufficiently far for the guiding fingers 51 to close in front of the anvil 47, before the collar starts to move backwards, with or without space between the two elements, as discussed previously.

Figure 9:
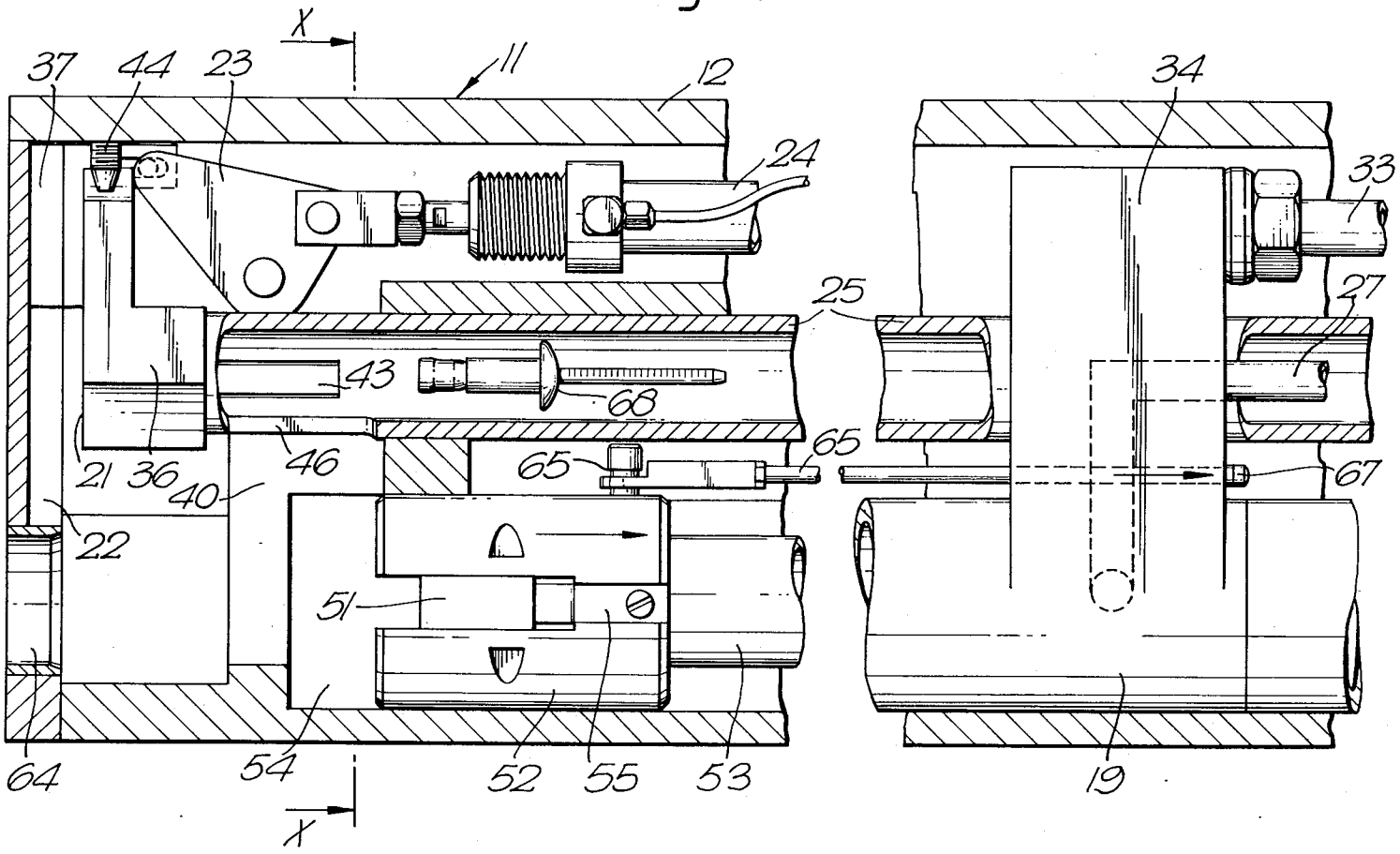

This stage is illustrated in FIG. 9, which also shows a further rivet 68 being blown down the tube 25, towards the waiting support and transfer fingers. The system then is ready to start another rivet installation cycle.

In practice, it may be arranged that the system may be at rest, i.e. awaiting an external command to the sequencer 14 to continue with the cycle, at any convenient stage in the cycle just described. For example, if the system is to be used to instal a rivet in a workpiece to be presented to it manually, it would be arranged that the system is at rest with the installation head fully advanced and awaiting hydraulic actuation to instal the rivet. Alternatively, if the workpiece is to be positioned in advance, the system would be arranged to be at rest at an earlier stage, e.g. with the installation head retracted but a rivet ready at the pick-up position.

The invention is not restricted to the details of the foregoing example.

We claim:

1. Apparatus for installing fasteners, which apparatus includes:

a fastener installation head including an aperture having a front end, into which aperture one part of the fasteners is inserted through said front end thereof so that the fastener can be acted on by the installation head when another part of the fastener is inserted in a workpiece, thereby to install the fastener in the workpiece;

and fastener feeding means for feeding new fasteners successively to the front of the aperture of the installation head;

which fastener feeding means comprises:

fastener supporting means which can take up an operative position for supporting a new fastener to be inserted into the aperture of the installation head, the fastener supporting means and the fastener installation head being movable relative to each other so that said one part of the fastener may approach the aperture to enter therein, and fastener guiding means which can take up an operative position for guiding the said one part of an approaching fastener into the aperture, each of the fastener supporting means and fastener guiding means being movable to a retracted position in which said fastener supporting means and said fastener guiding means allow said another part of the fastener access to a workpiece in which it is to be installed whilst the one part of the fastener is still inserted into the aperture in the fastener installation head to be acted on thereby, wherein said fastener guiding means and the fastener installation head are movable relative to each other and wherein said fastener guiding means is movable from its operative position to its retracted position by means of engagement of the installation head with said fastener guiding means during continued movement of the instllation head relative to the fastener guiding means in a direction towards the workpiece in which the fastener is to be installed, in a position which is beyond the fastener guiding means on that side thereof which is remote from the side thereof form which the installation heasd approaches the fastener guiding means.

2. Apparatus for installing fasteners, which apparatus includes:

a fastener installation head including an aperture having a front end into which aperture one part of the fastener is inserted through said front end thereof so that the fatener can be acted on by the installation head when another part of the fastener is inserted in a workpiece, thereby to install the fastener in the workpiece;

and fastener feeding means for feeding new fasteners successively to the front of the aperture of the installation head;

which fastener feeding means comprises:

fastener supporting means which can take up an operative position for supporting a new fastener to be inserted into the aperture of the installation head, the fastener supporting means and the fastener installation head being movable relative to each other so that said one part of the fastener may approach the aperture to enter therein, and fastener guiding means which can take up an operative position for guiding the said one part of an approaching fastener into the aperture, each of the fastener supporting means and fastener guiding means being movable to a retracted position in which said fastener supporting means and said fastener guiding means allow said another part of the fastener access to a workpiece in which it is to be installed whilst the one part of the fastener is still inserted into the aperture in the fastener installation head to be acted on thereby, the fastener guiding means and the fastener installation head being movable relative to each other, the fastener guiding means being movable from its operative position to its retracted position by means of engagement of the installation head with said fastener guiding means during relative movement therebetween, the fastener guiding means comprising a plurality of guiding members, movable relatively towards each other into operative position of the guiding means in which the guiding members are relatively close together to guide the aforesaid one part of the fastener between them, and relatively away from each other into the retracted position of the guiding means in which the guiding members are relatively spaced apart to allow passage of the fastener installation head between them to allow the another part of the fatener access to a workpiece as aforesaid, in which the fastener installation head engages with the guiding members on relative movement of the installation head towards the guiding means, to move them out of the guiding position and into the retracted position.

3. Apparatus for installing fasteners, which apparatus includes:

a fastener installation head including an aperture having a front end into which aperture one part of the fastener is inserted through said front end thereof so that the fastener can be acted on by the installation head when another part of the fastener is inserted in a workpiece, thereby to install the fastener in the workpiece;

and fastener feeding means for feeding new fasteners successively to the front of the aperture of the installation head;

which fastener feeding means comprises:

fastener supporting means which can take up an operative position for supporting a new fastener to be inserted into the aperture of the installation head, the fastener supporting means and the fastener installation head being movable relative to each other so that said one part of the fastener may approach the aperture to enter therein, and fastener guiding means which can take up an operative position for guiding the said one part of an approaching fastener into the aperture, each of the fastener supporting means and fastener guiding means being movable to a retracted position in which said fastener supporting means and said fastener guiding means allow said another part of the fastener access to a workpiece in which it is to be installed whilst the one part of the fastener is still inserted into the aperture in the fastener installation head to be acted on thereby, the fastener guiding means and the fastener installation head being movable relative to each other, the fastener guiding means being movable from its operative position to its retracted position by means of engagement of the insntallation head with said fastener guiding means during relative movement therebetween, the fastener guiding menas being arranged for limited movement with the installation head upon engagement thereby, including stop means for limiting forward movement of the guiding means to cause further advance of the installation head relative to the guiding means to move the guiding means from its operative position to its retracted position.

4. Apparatus as claimed in claim 3, in which the guiding means is connected to the installation head for axial reciprocation therewith, there being lost motion to allow further advance of the installation head when the stop means limits forward movement of the guiding means as aforesaid.

5. Apparatus for installing fasteners, which apparatus includes:

a fastener installation head including an aperture having a front end into which aperture one part of the fastener is inserted through said front end thereof so that the fastener can be acted on by the installation head when another part of the fastener is inserted in a workpiece, thereby to install the fastener in the workpiece;

and fastener feeding means for feeding new fasteners successively to the front of the aperture of the installation head;

which fastener feeding means comprises:

fastener supporting means which can take up an operative position for supporting a new fastener to be inserted into the aperture of the instllation head, the fastener supporting means and the fastener installation heads being movable relative to each other so that said one part of the fastener may approach the aperture to enter therein, and fastener guiding means which can take up an operative position for guiding the said one part of an approaching fastener into the aperture, each of the fastener supporting menas and fastener guiding means being movable to a retracted position in which said fastener supporting means and said fastener guiding means allow said another part of the fastener access to a workpiece in which it is to be installed whilst the one part of the fastener is still inserted into the aperture in the fastener installation head to be acted on thereby, wherein said fastener guiding means comprises a plurality of guiding members, movable relatively towards each other into the operative position of the guiding means in which the guiding members are relatively close together to guide the aforesaid one part of the fastener between them, and relatively away from each other into the retracted position of the guiding means in which the guiding members are relatively spaced apart to allow passage of the fastener installation head between them to allow another part of the fastener access to a workpiece as aforesaid.

6. Apparatus as claimed in claim 1 or claim 5, in which:

the fastener supporting means in its operative position supports a new fastener at a pick-up position axially in front of the installation head;

the installation head is movable axially towards the fastener supporting means to pickup the fastener in the pick-up position by means of the one part of the fastener being inserted in the aperture of the installation head as it approaches the supporting means;

the new fastener is fed to the pick-up position by movement of said fastener feeding means in a direction transverse to the movement of the installation head;

and the fastener guiding means is supported so as to be reciprocable, away from the fastener pick-up position so as to allow transverse movement of the fastener into the pick-up position clear of the guiding means, and towards the fastener in the pick-up position to guide the first part thereof into the aperture of the installation heads as they approach each other.

7. Apparatus as claimed in claim 6, in which the fastener guiding means is advanced by engagement of the advancing installation head therewith.

8. Apparaus as claimed in claim 1 or claim 2 or claim 3 or claim 5, in which the fastener supporting means is movable from its operative position to its retracted position by means of engagement of the installation head therewith during relative movement between then as aforesaid.

9. Apparatus as claimed in claim 8 in which the fastener supporting means comprises a plurality of supporting members movable relatively towards each other, into the operative position of the supporting means in which the supporting members are relatively close together to support the fastener between them, and relatively away from each other into the retracted position of the supporting means in which the supporting members are relatively spaced apart to allow passage of the fastener installation head between them to allow the another part of the fastener access to a workpiece as aforesaid, and in which the fastener installation head engages with the supporting members on sufficient relative movement of the installation head towards the supporting means, to move them out of the supporting position and into the retracted position.

10. Apparatus as claimed in claim 1 or claim 2 or claim 3 or claim 5, in which the fastener supporting means comprises a plurality of supporting members movable relatively towards each other, into the operative position of the supporting means in which the supporting members are relatively close together to support the fastener between them, and relatively away from each other into the retracted position of the supporting means in which the supporting members are relatively spaced apart to allow passage of the fastener installation head between them to allow the another part of fastener access to a workpiece as aforesaid.

* * * * *